US007413464B1

(12) United States Patent
Chen

(10) Patent No.: US 7,413,464 B1
(45) Date of Patent: Aug. 19, 2008

(54) SOCKET WITH INTEGRATED INSULATION DISPLACEMENT CONNECTION TERMINALS

(75) Inventor: Chou-Hsing Chen, Keelung (TW)

(73) Assignee: Surtec Industries Inc., Keelung (TW)

( * ) Notice: Subject to any disclaimer, the term of this patent is extended or adjusted under 35 U.S.C. 154(b) by 0 days.

(21) Appl. No.: 11/808,742

(22) Filed: Jun. 12, 2007

(30) Foreign Application Priority Data

Mar. 21, 2007 (TW) ..... 96204560 U

(51) Int. Cl.
*H01R 4/24* (2006.01)

(52) U.S. Cl. ..... 439/404; 439/417; 439/676; 439/467

(58) Field of Classification Search ..... 439/404, 439/417, 467, 676, 460, 596, 695, 686
See application file for complete search history.

(56) References Cited

U.S. PATENT DOCUMENTS 4,169,648 A * 10/1979 Moist, Jr. ..... 439/467
5,586,916 A * 12/1996 Shinji et al. ..... 439/752
5,957,720 A * 9/1999 Boudin ..... 439/417
6,126,478 A * 10/2000 Presson et al. ..... 439/467
6,478,609 B1 * 11/2002 Davis et al. ..... 439/470
6,663,411 B2 * 12/2003 Little ..... 439/352
6,878,009 B2 * 4/2005 Amemiya ..... 439/470
7,001,204 B1 * 2/2006 Lin ..... 439/418

* cited by examiner

*Primary Examiner*—Hien Vu
(74) *Attorney, Agent, or Firm*—Birch, Stewart, Kolasch & Birch, LLP

(57) ABSTRACT

A socket with integrated insulation displacement connection terminals is provided, which includes a base, a terminal pusher, a first pressing element, and a second pressing element. The base has two rows of insulation displacement connection terminals engaged in one side thereof. The terminal pusher has two rows of receiving holes corresponding to each of the IDC terminals, for a plurality of wires bridging across one of holes respectively. The first pressing element is pivoted to the base to be rotated to press the terminal pusher through first pressing portions, such that each IDC terminal is inserted into each receiving hole and each wire is introduced in a corresponding IDC terminal. The second pressing element is pivoted to the base to be rotated to press against the first pressing element through second pressing portions, so as to fix the terminal pusher to the base.

8 Claims, 12 Drawing Sheets

SOCKET WITH INTEGRATED INSULATION DISPLACEMENT CONNECTION TERMINALS

CROSS-REFERENCE TO RELATED APPLICATIONS

This non-provisional application claims priority under 35 U.S.C. § 119(a) on Patent Application No(s). 096204560 filed in Taiwan, R.O.C. on Mar. 21, 2007, the entire contents of which are hereby incorporated by reference.

BACKGROUND OF THE INVENTION

1. Field of the Invention

The present invention relates to connecting wires to a socket, and more particularly to a socket with integrated insulation displacement terminals for a plurality of wires to be introduced therein.

2. Related Art

FIGS. 1, 2, and 3 show a commonly used communication socket, which includes a socket base 10, a terminal pusher 11, and two pressing covers 12. The socket base 10 has two rows of inserted slot 13 on one side, and each inserted slot 13 is equipped with a insulation displacement terminal 14 (IDC terminals) disposed therein. The terminal pusher 11 has a plurality of clamping slots 15 on one side. The terminal pusher 11 has a through hole 16 and four hooks 17 on the other side, and a plurality of wires 20 pass through the terminal pusher 11 via the through hole 16 and are arranged in each clamping slot 15. Each pressing cover 12 is pivoted to the socket base 10 to be rotated relatively to the socket base 10. Each outer cover 12 is respectively opened with two hooked holes 18 corresponding to each hook 17 of the terminal pusher 11 respectively.

When it is intended to electrically connect the wires 20 to the socket base 10, each signal wire 20 is first placed in the clamping slots 15 socket base 10, such that the clamping slot 15 of the terminal pusher 11 and each signal wire 20 are made to align with each inserted slot 13 of the socket base 10. At this time, the two outer covers 12 opened to a certain position, and the terminal pusher 11 and the signal wires 20 are engaged to the socket base 10. Then, one of the pressing covers 12 is rotate towards the terminal pusher 11. The pressing cover 12 is rotated to cover and press against a half portion of the terminal pusher 11. As the terminal pusher 11 is pressed to close the socket base 10, the IDC terminals 14 is engaged into the terminal pusher 11, while the wires 20 are pressed into each inserted slot 13 of the socket base 10, such that the insulation layer of each signal wire 20 is cut by a corresponding IDC terminal and the wire 20 is introduced in the terminal 14 to accomplish an electrical connection. The other half portion of the terminal pusher 11 is then pressed, such that the terminal pusher 11 inclines relative to the socket base 10. Then, after the pressing cover 12 presses against the terminal pusher 11, each hook 17 of the terminal pusher 11 is engaged into the hooked holes 18 of the pressing cover 12, such that one of the pressing covers 12 is fixed on the socket base 10. Finally, the other pressing cover 12 is rotated to press against the other half portion of the terminal pusher 11, so as to completely introduce all the wires in the IDC terminals.

The outer covers 12 aforementioned are two separate elements, and when each outer cover 12 covers the terminal pusher 11 respectively, only half of the wires 20 are forced to be introduced in half of the IDC terminals 14, and the terminal pusher 11 inclines during the operation. As a result, a part of wires 20 are easily stripped off from the terminal pusher 11 due to the incautious operation of the user. Once a part of signal wires 20 are stripped off, the wires 20 should be rearranged, which is inconvenient in operation and further affects the working efficiency of the wiring operation.

In view of the above problems, U.S. Pat. No. 5,957,720 has disclosed a socket, which uses two jaws to press the wires into the IDC terminals, so as to accomplish the electrical connection. However, although each jaw has two end branches as mentioned in U.S. Pat. No. 5,957,720, each jaw only has one end branch directly aligned with the IDC terminals, and thus, one jaw can only exert force on one row of IDC terminals. This situation is similar to the above examples, which causes force exerted to the IDC terminals to be non-uniform, so as to cause inconveniences in the operation. Moreover, the jaw mentioned in U.S. Pat. No. 5,957,720 lacks of the function of fixing the stranded wires, such that the wires are easily stripped off from the IDC terminals once the stranded wires are dragged, and the wires stranded into a cable is vertical to the socket base, so as to increase the additional space for allocating the socket base, which thus is not suitable for being used in the server host that occupies a small space.

SUMMARY OF THE INVENTION

As for the communication sockets of the prior art, two processes are required to press all the wires to be introduced in the IDC terminals, such that a part of the wires are easily stripped off during the operation. In view of the above problems, the object of the present invention is to provide a socket with integrated insulation displacement terminals, which presses all the wires to be introduced in IDC terminals at one time, so as to improve the positioning effect during the wiring operation.

In order to achieve the above object, the present invention provides a socket with integrated insulation displacement terminals (IDC terminals), which includes a base, a terminal pusher, a first pressing element, and a second pressing element. The base has two rows of IDC terminals engaged in one side. The terminal pusher has two rows of receiving holes corresponding to each of the IDC terminals respectively, for a plurality of signal wires bridging across each of the receiving holes respectively. The first pressing element is pivoted to the base and has two first pressing portions respectively corresponding to the two rows of IDC terminals, wherein the first pressing element is rotatable to presses the terminal pusher through the first pressing portions, such that each of the IDC terminals is inserted into one of the receiving holes respectively, and each of wires is introduced in the corresponding IDC terminal. Thus, the wires are electrically connected to the IDC terminals. The second pressing element is pivoted to the base and has two first pressing portions, wherein the second pressing element is rotatable to press against the first pressing element through the second pressing portions, so as to fix the terminal pusher to the base.

The advantage of the present invention lies in that, the two first pressing portions of the first pressing element are able to press all the wires to be introduced in the IDC terminals at the same time, and effectively prevents the wires from being stripped off during the wiring process, so as to improve the assembling efficiency of the signal communication socket.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The descriptions of the above summary of the present invention and the following detailed description of the present invention are intended to demonstrate and explain the principles of the present invention, and to provide a further explanation of the claims of the present invention.

BRIEF DESCRIPTION OF THE DRAWINGS

The present invention will become more fully understood from the detailed description given herein below for illustration only, which thus is not limitative of the present invention, and wherein.

DETAILED DESCRIPTION OF THE INVENTION

Figure 1:
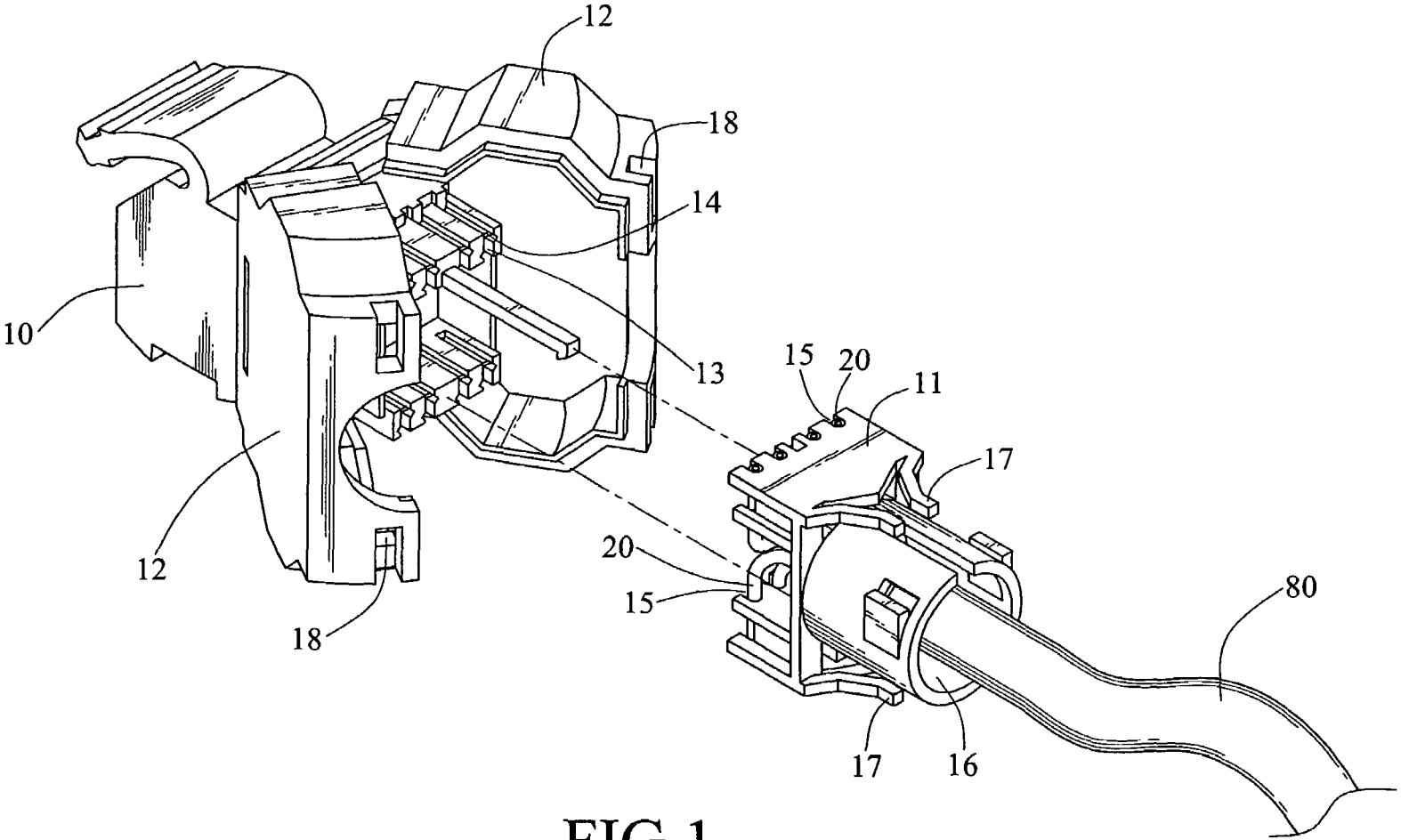
FIG.1 (PRIOR ART)
FIG. 1 is an exploded view of a commonly used communication socket and wires in the prior art.
Figure 2:
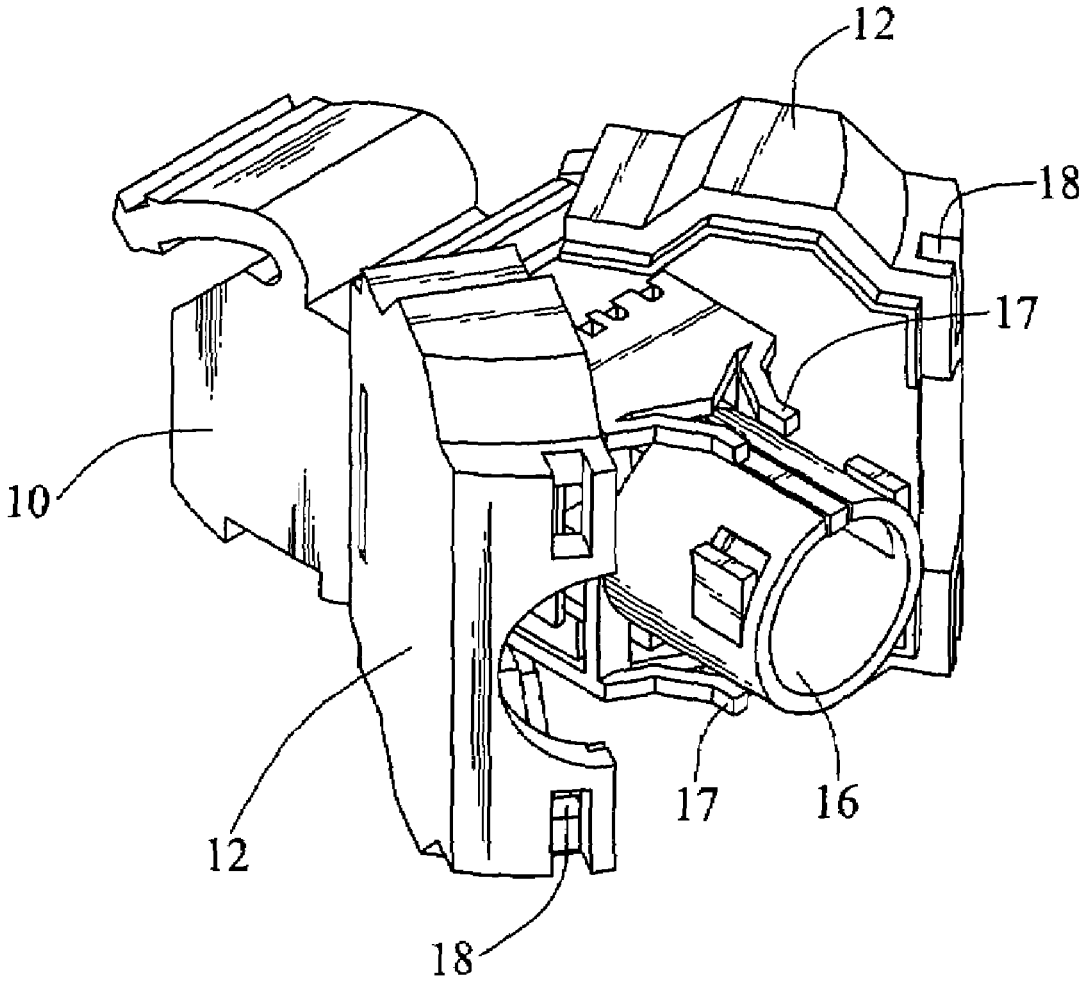
FIG.2 (PRIOR ART)
FIG. 2 is a perspective view of the commonly used communication socket in the prior art.
Figure 3:
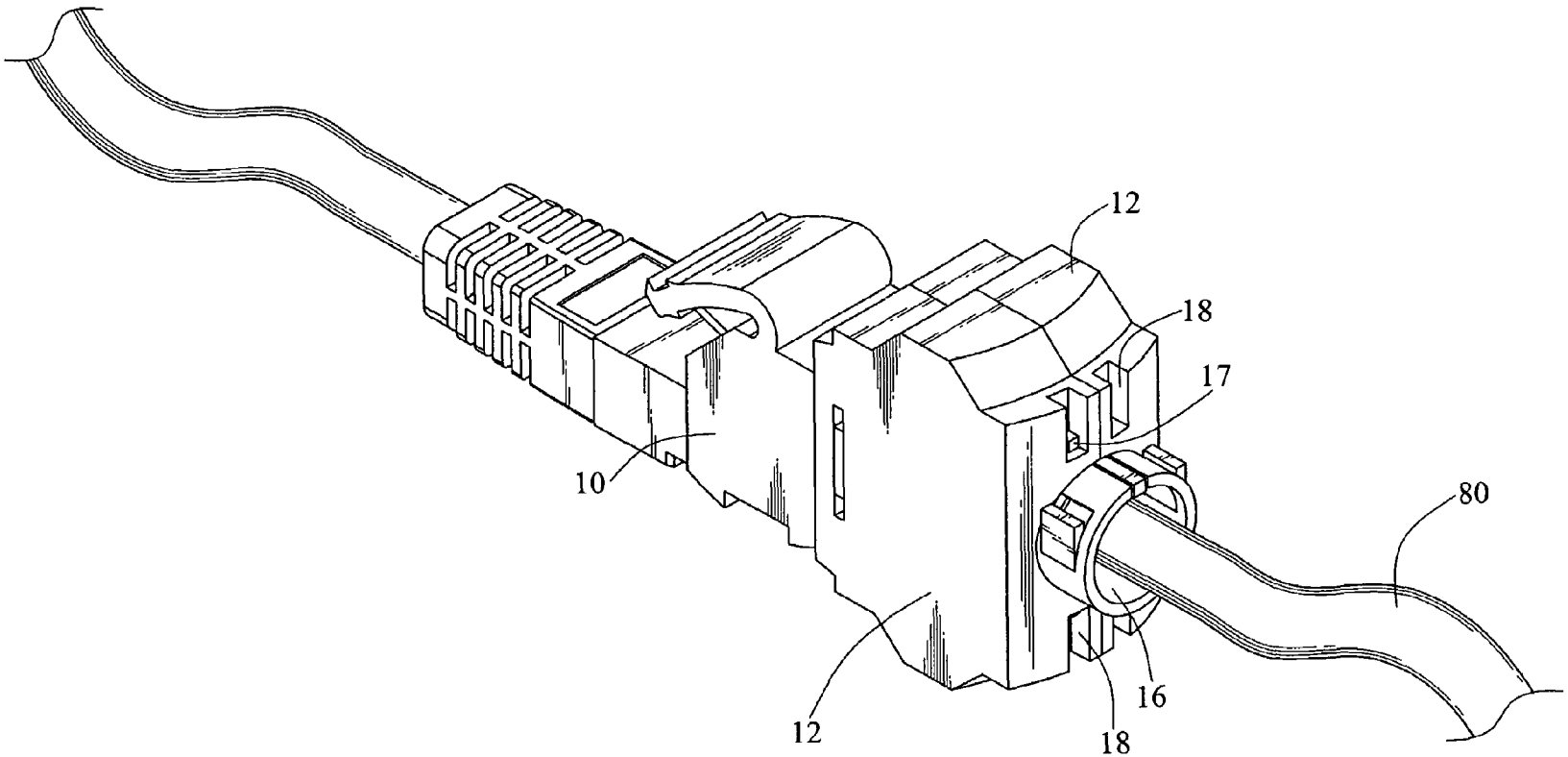
FIG.3 (PRIOR ART)
FIG. 3 is a perspective view of the commonly used communication socket and wires in the prior art.
Figure 4:
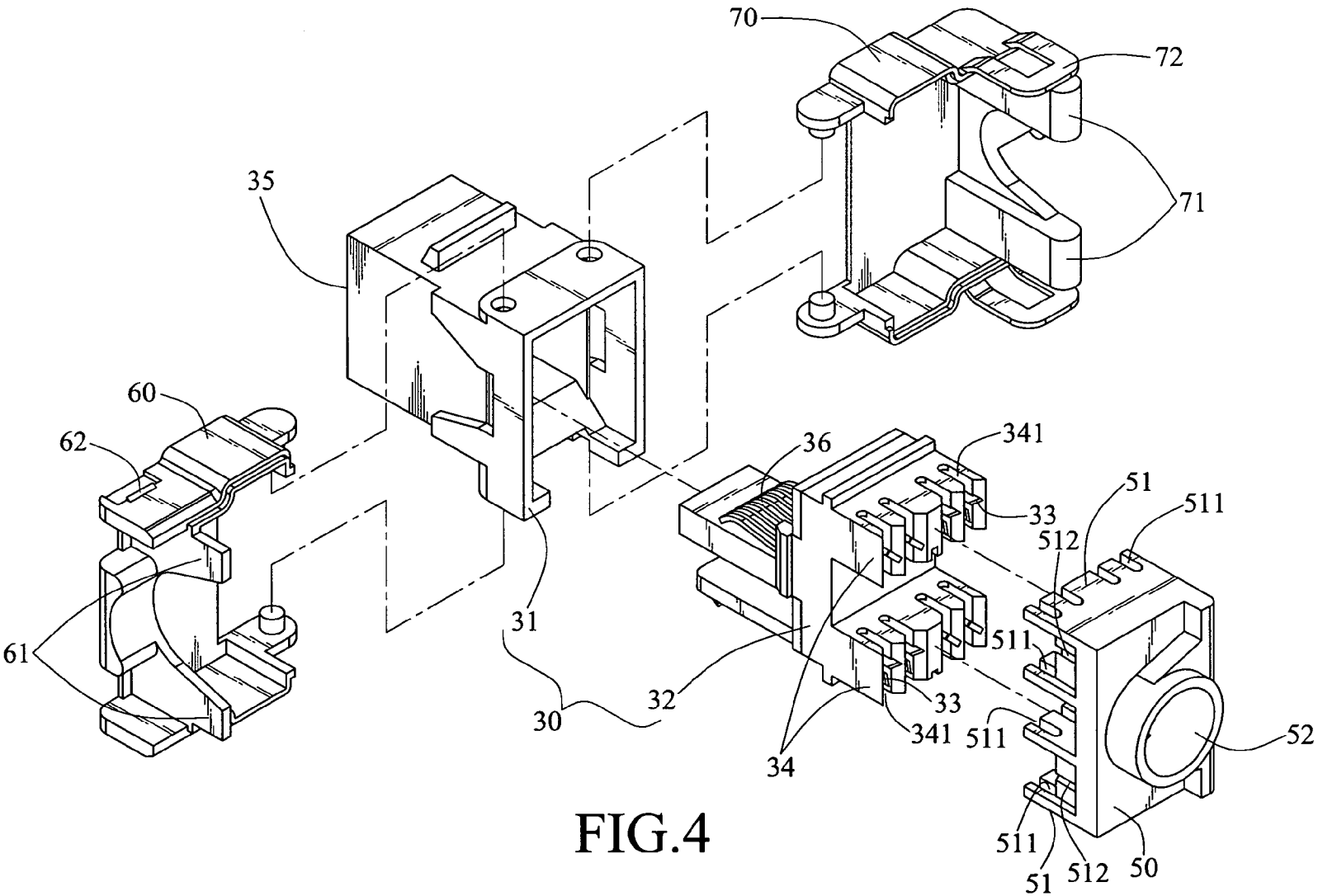
FIG. 4 is an exploded view of a socket with integrated insulation displacement connection terminals according to an embodiment of the present invention.
Figure 5:
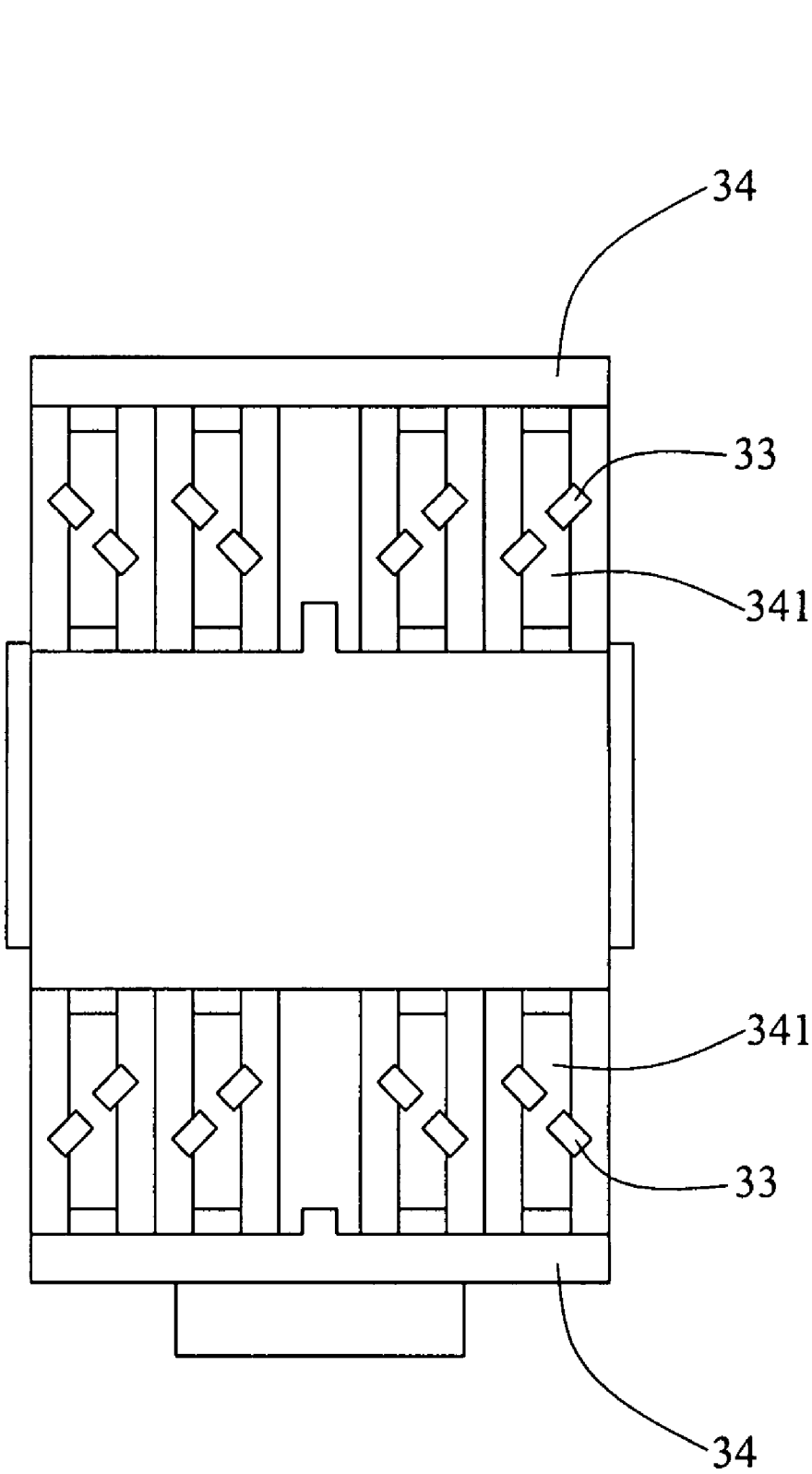
FIG. 5 is a planar view of a terminal block of a base according to the embodiment of the present invention.
Figure 6:
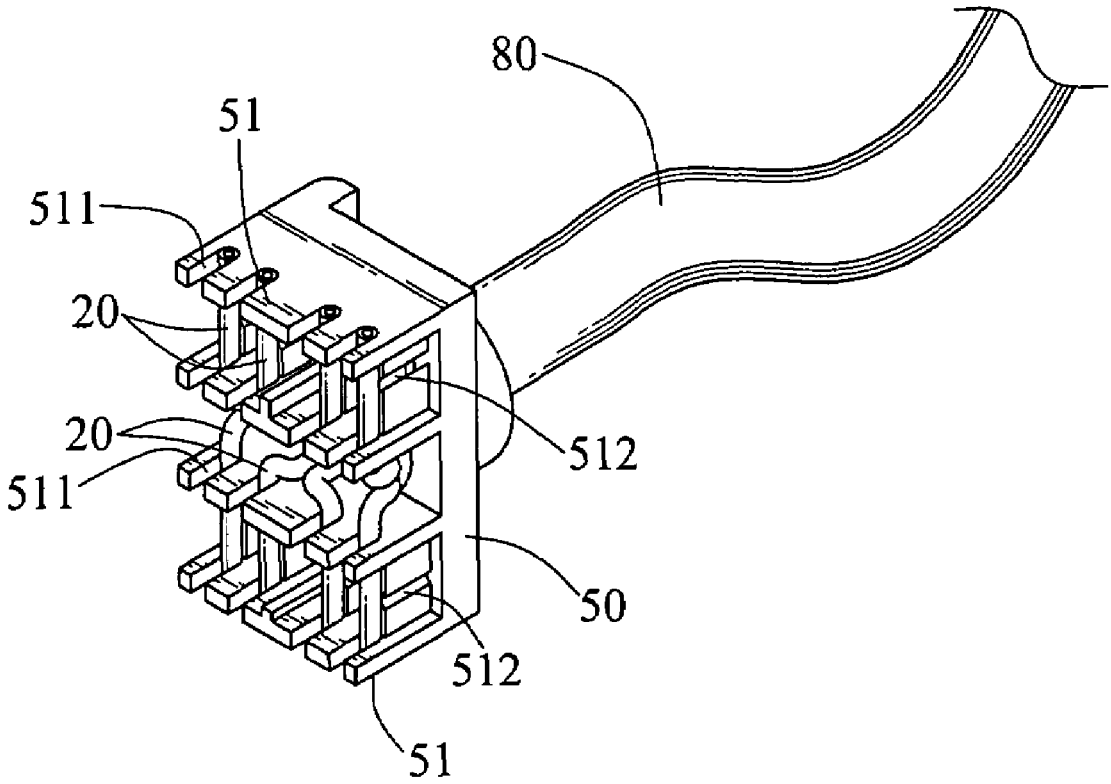
FIG. 6 is a perspective view of a terminal pusher and wires according to the embodiment of the present invention.
Figure 7:
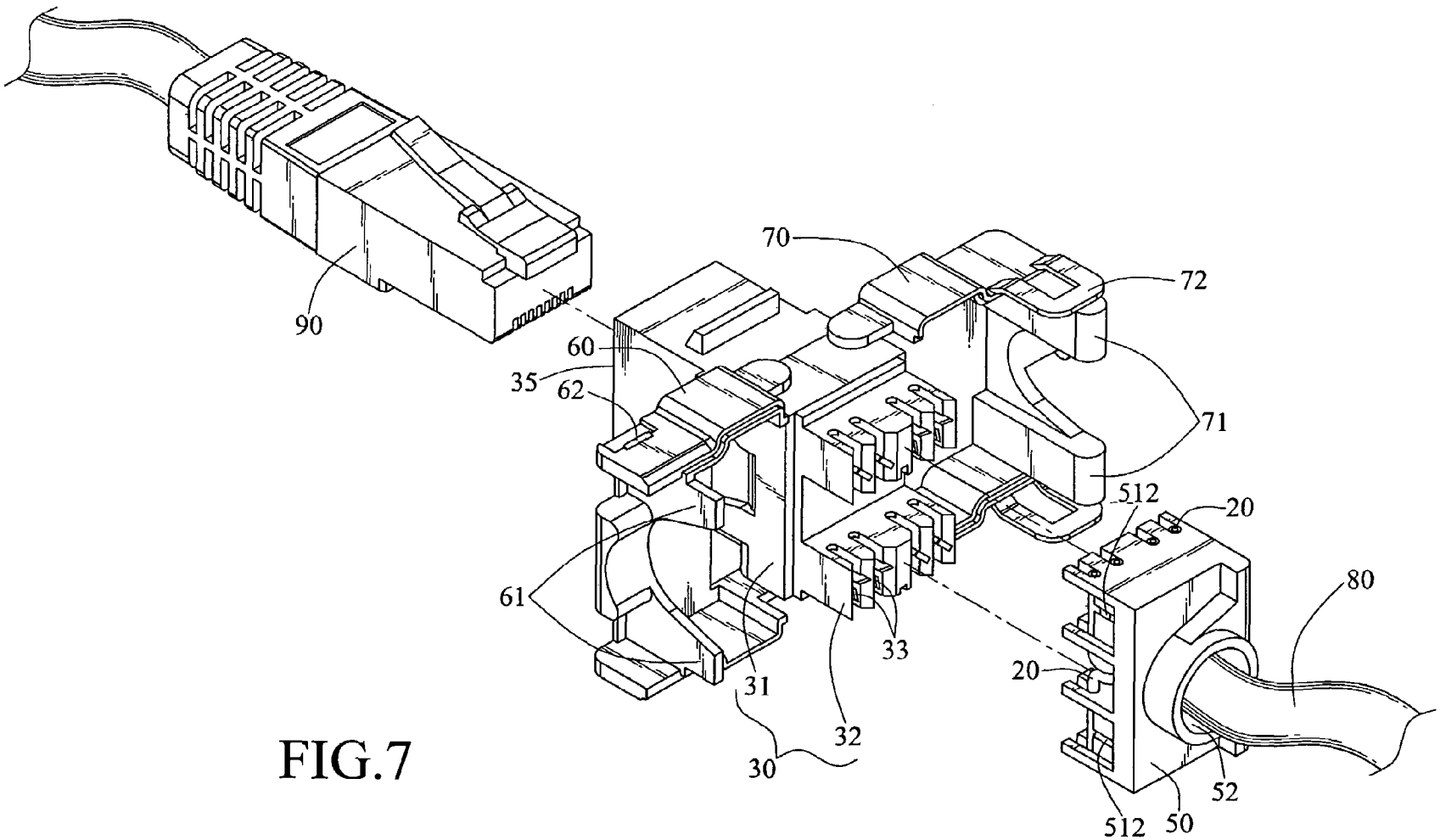
FIG. 7 is an exploded view of the socket, a plug, and a cable according to the embodiment of the present invention.
Figure 8:
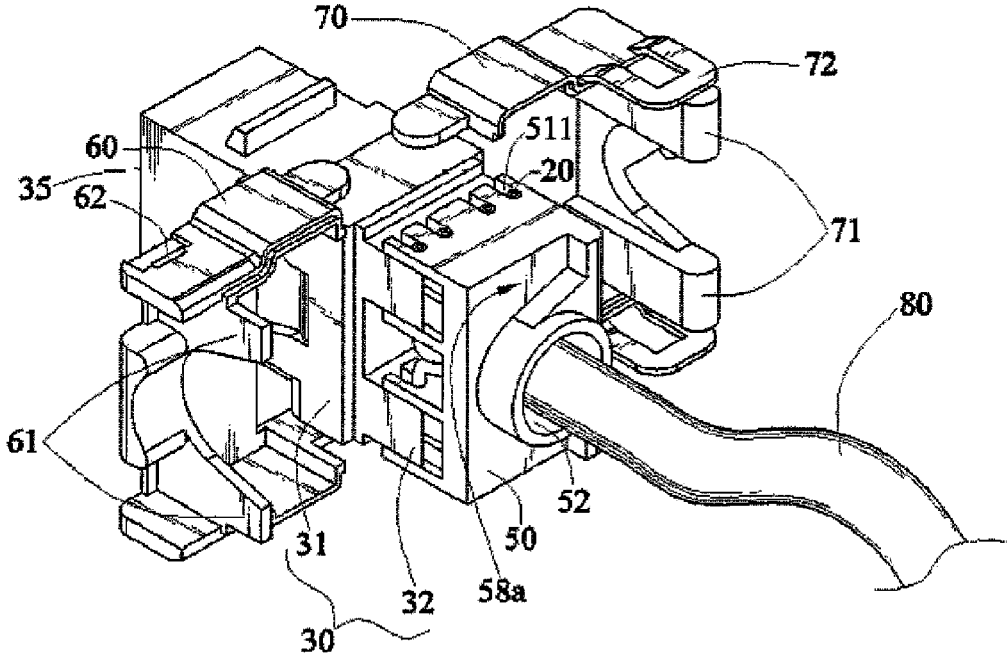
FIGS. 8, 9, 10 are perspective views of the socket and the terminal pusher according to the embodiment of the present invention.
Figure 9:
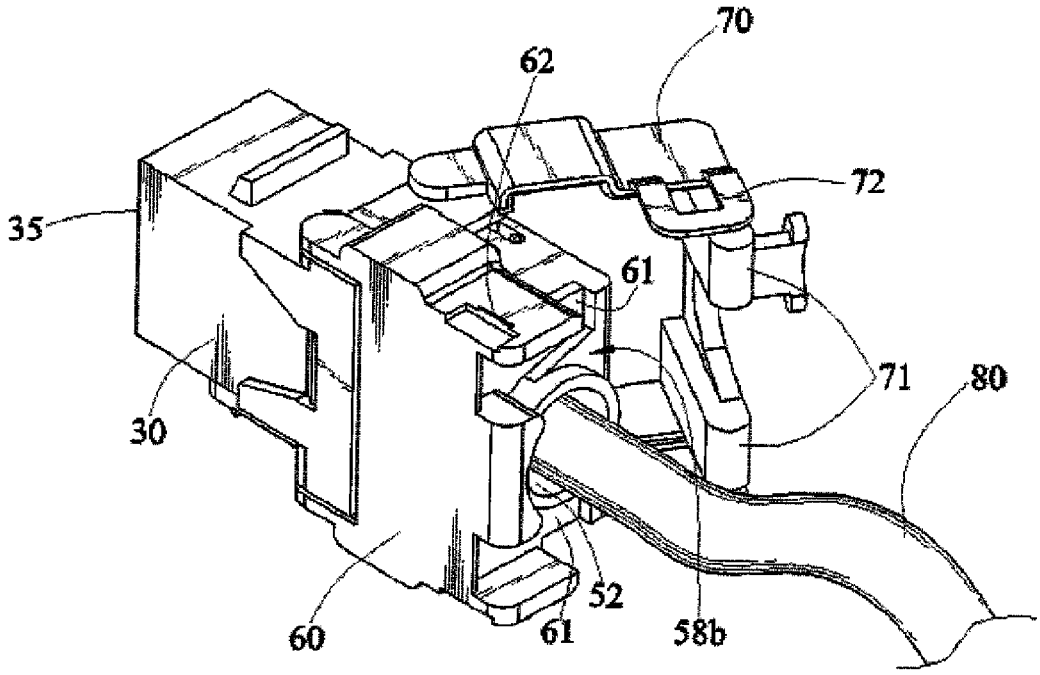
Figure 10:
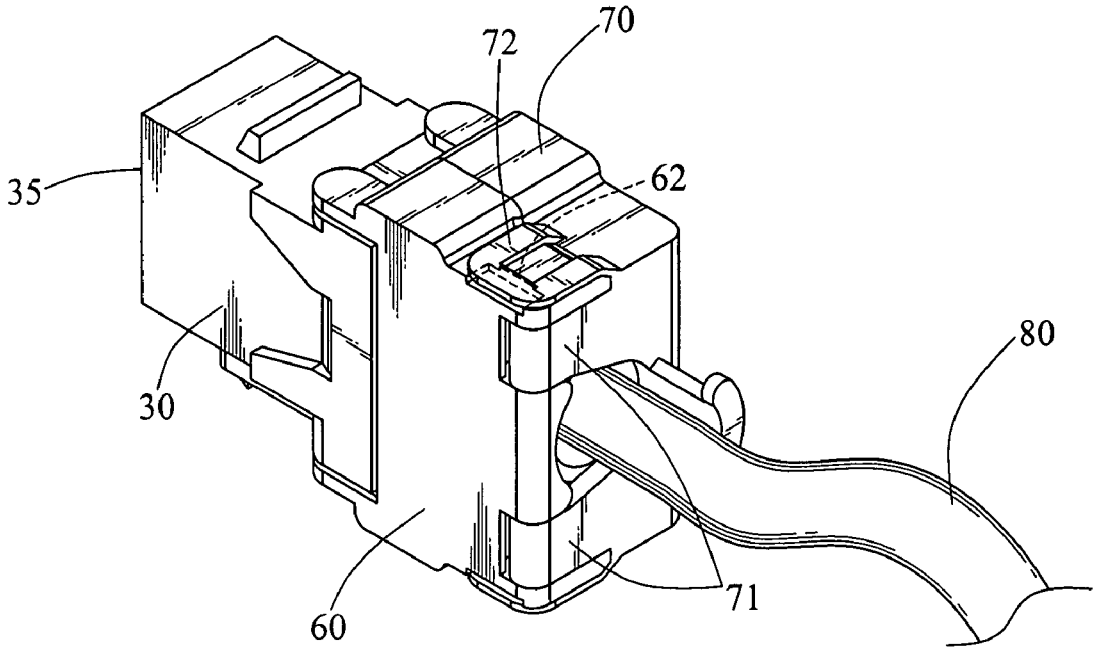
Figure 11:
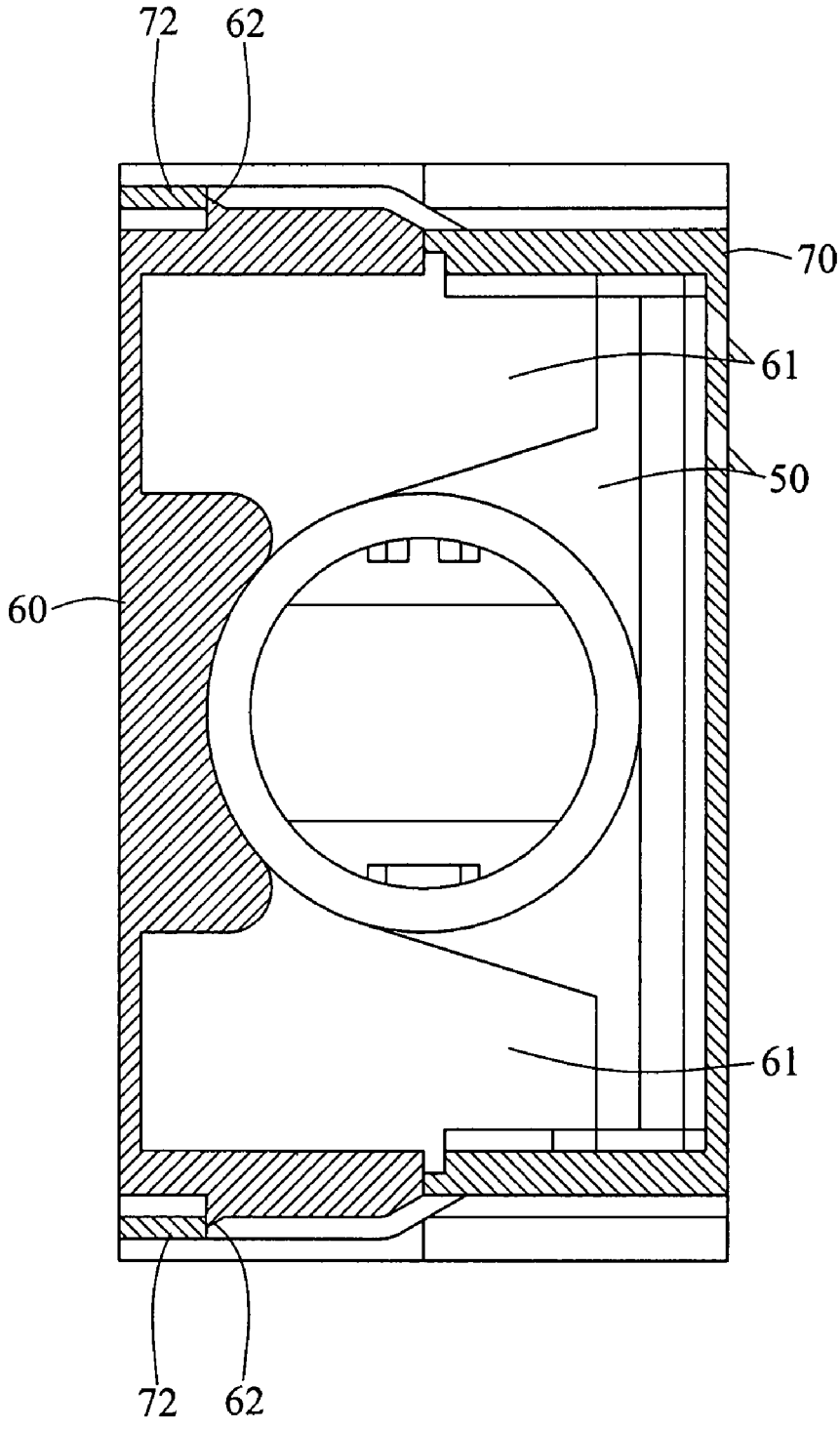
FIG. 11 is a cross-sectional view of the terminal pusher, a first pressing element, and a second pressing element in the socket according to the embodiment of the present invention.

In order to make the aforementioned and other objects, features, and advantages of the present invention be comprehensible, preferred embodiments accompanied with figures are described in detail below.

Referring to FIGS. 4, 5, 6, and 7, a socket with integrated insulation displacement connection terminals according to an embodiment of the present invention is provided. A plurality of wires 20 stranded into a cable 80 is able to be connected to the socket, so as to electrically connect the wires 20 to a plug 90 inserted into the socket. The socket includes a base 30, a terminal pusher 50, a first pressing element 60, and a second pressing element 70.

The base 30 has a housing 31, a terminal block 32, and twos of insulation displacement connection terminals 33 (IDC terminals). The base 30 further has a recess 35 formed on the front side of the terminal block 32 for receiving a plug 90 to be inserted therein. The terminal block 32 is mounted to the housing 31, and has two parallel terminal engaged portions 34 on one side. Each terminal engaged portion 34 respectively has a plurality of inserted slots 341. That is, two rows of inserted slots 341 are arranged on the back side of the terminal block 32 of the base 30. Each IDC terminals 33 is respectively inserted into each inserted slot 341, and extends towards the recess 35 formed on the front side of the base 30, such that the plurality of IDC terminals 33 is engaged on the back side of the base 30, and is arranged in two parallel rows. The terminal block 32 has a plurality of contact pieces 36 disposed therein, wherein one end of each contact piece 36 is bent and located in the recess 35, and the other end of each contact piece 35 is electrically connected to each of the IDC terminals 33 respectively. Once the plug 90 is inserted into the recess 35, the contact pieces (not shown) of the plug 90 contact with each contact piece 36 of the terminal block 32, so as to electrically connect the plug 90 to the contact piece 36 and the IDC terminals 33.

The terminal pusher 50 has two receiving portions 51 and a through hole 52 passing through the terminal pusher 50 from the back side. Each receiving portion 51 is respectively corresponding to each terminal engaged portion 34 of the terminal block 32, and has a plurality of clamping slots 511 and a plurality of receiving holes 512 corresponding to the clamping slots 511. Each receiving hole 512 is respectively corresponding to the IDC terminals 33 in each inserted slot 341. The terminal pusher 50 is used to insert into the terminal block 32 on the back side of the base 30, such that each IDC terminal 33 is inserted into a corresponding receiving hole 512.

A plurality of wires 20 are stranded into a cable 80, and the cable 80 passes through the terminal pusher 50 via the through hole 52, and each signal wire 20 is placed into one or more clamping slots 511. The clamping slots 511 clamp the signal wires 20, such that the each wire 20 bridges across a corresponding receiving hole 512. When the IDC terminals 33 is inserted into the receiving holes 52 of the terminal pusher 52, each wire 20 is respectively introduced in a corresponding IDC terminal 33.

As shown in FIGS. 8, 9, 10, and 11, the first pressing element 60 is pivoted to one side of the base 30, has two first pressing portions 61 and two first latch portions 62. Each first pressing portion 61 is respectively corresponding to each row of IDC terminals 33, and covers the edge of the through hole 52 of the terminal pusher 50. The first pressing element 60 is rotatable to press against the terminal pusher 50 through the first pressing portions 61; i.e., the first pressing element 60 is rotatable to let the first pressing portions 61 to be fitted into a first rear groove 58*a* of the terminal pusher 50 so to press on the terminal pusher 50, such that the IDC terminals 33 are forced to be inserted into the receiving holes 512, such that each IDC terminal 33 cuts through the insulation layer outside the wire 20 to contact with the internal conductive material, so as to introduce each signal wire 20 in each IDC terminal 33.

The second pressing element 70 is pivoted to the other side of the housing 31 of the base 30, and corresponding to the first pressing element 60. The second pressing element 70 has two second pressing portion 71 and two second latch portions 72. The second pressing element 70 is rotatable to press the first pressing element 60 and the terminal pusher 50 i.e., the second pressing element 70 is rotatable to let the second pressing portions 71 to be fitted into a second rear groove 58*b* of the first pressing element 60 to press against the first pressing portions 61 of the first pressing element 60. Each second latch portion 72 is respectively provided corresponding to each first latch portion 62 of the first pressing element 60, and once the second pressing element 70 presses against the first pressing element 60, each second latch portion 72 is respectively engaged with each first latch portion 62, so as to combine the first pressing element 60 and the second pressing element 70, and to fix the terminal pusher 50 and the wires 20 on the base 30.

Figure 12:
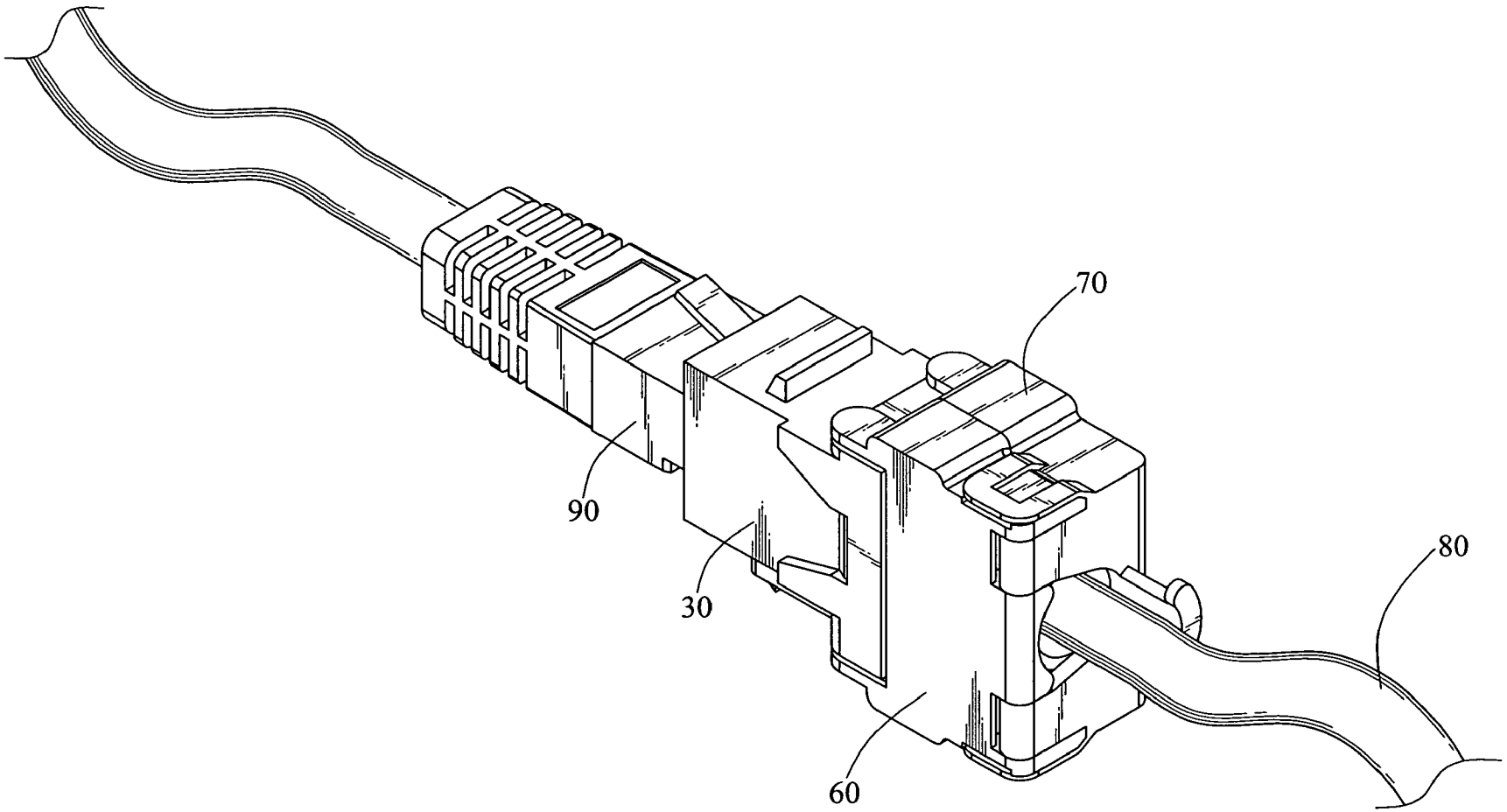
FIG. 12 is a perspective view of the socket, the plug, and the cable according to the embodiment of the present invention.

As shown in FIG. 12, the recess 35 on the front side of the base 30 is provided for the plug 90 to be inserted therein, so as to electrically connect the plug 90 with the IDC terminals 33 within the base 30. The terminal block on the back side of the base 30 is provided for the terminal pusher 50 to be inserted therein, and the first pressing element 60 is used to press the terminal pusher 50, such that each wire 20 of the cable 80 is electrically connected with each IDC terminal 33. Therefore, the cable 80 is electrically connected with the plug 90 through the conductive elements (IDC terminals 33 and contact pieces 36) integrated within the base 30. Moreover, by means of latching the second pressing element 70 with the first pressing element 60, the cable 80 is firmly connected with the base 30.

Based on the above, as for the socket with integrated IDC terminals of the present invention, after the first pressing element 60 is rotated, the first pressing portions 61 move to positions above the two rows of IDC terminals 33 at the same time, and all the wires 20 are pressed to be introduced in each IDC terminal 33 at one time, while the cable 80 is connected, so as to prevent the terminal pusher 50 from being inclined upon being pressed, and effectively prevent the wires 20 from being stripped off during the wiring process. Compared with the socket in the art or the U.S. Pat. No. 5,957,720 that cannot exert a force uniformly on the IDC terminals, the present invention can enhance the overall assembling efficiency. The second pressing element 70 is also engaged with and covers the first pressing element 60, to clamp and fix the cable 80, so as to firmly connect the cable 80 with the signal socket of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A socket with integrated insulation displacement connection terminals, comprising:

a base, having two rows of insulation displacement connection terminals engaged in one side of the base;

a terminal pusher, having two rows of receiving holes corresponding to each insulation displacement connection terminal respectively, wherein a plurality of wires bridges across each of the receiving holes respectively;

a first pressing element pivoted to the base and having two first pressing portions respectively corresponding to the two rows of insulation displacement connection terminals, wherein the first pressing element is rotatable to let the first pressing portions be fitted into a first rear groove of the terminal pusher so to press on the terminal pusher, such that each of the insulation displacement connection terminals is inserted into one of the receiving holes and each of the wires is introduced in the corresponding insulation displacement connection terminals; and a second pressing element pivoted to the base, and having two second pressing portions, wherein the second pressing element is rotatable to let the second pressing portions to be fitted into a second rear groove of the first pressing element to press against the first pressing portions of the first pressing element.

2. The socket with integrated insulation displacement connection terminals as claimed in claim 1, wherein the base further has a plurality of inserted slot arranged on the side of the base, wherein each of the insulation displacement connection terminals is respectively disposed in each of the inserted slot.

3. The socket with integrated insulation displacement connection terminals as claimed in claim 2, wherein the terminal pusher further has a plurality of clamping slot for clamping the wires to bridge across the receiving hole.

4. The socket with integrated insulation displacement connection terminals as claimed in claim 1, wherein the base further has a recess formed on the other side of the base for receiving a plug to be inserted therein.

5. The socket with integrated insulation displacement connection terminals as claimed in claim 4, further comprising a plurality of contact terminals disposed in the base, wherein one end of each contact terminal is bent and located in the recess, and the contact terminal is electrically connected to each of the insulation displacement connection terminals respectively.

6. The socket with integrated insulation displacement connection terminals as claimed in claim 1, wherein wires are stranded into a cable.

7. The socket with integrated insulation displacement connection terminals as claimed in claim 6, wherein the terminal pusher further has a through hole for the cable to pass through the terminal pusher.

8. The socket with integrated insulation displacement connection terminals as claimed in claim 1, wherein the first pressing element has at least one first latch portion, and the second pressing element has at least one second latch portion for being engaged with the first latch portion, so as to combine the first pressing element and the second pressing element, and fix the terminal pusher on the base.

* * * * *